US012426654B1

(12) United States Patent
Alfordpinnock

(10) Patent No.: US 12,426,654 B1
(45) Date of Patent: Sep. 30, 2025

(54) HAIR STRAND STYLING DEVICE

(71) Applicant: Una Alfordpinnock, Sandy Springs, GA (US)

(72) Inventor: Una Alfordpinnock, Sandy Springs, GA (US)

( * ) Notice: Subject to any disclaimer, the term of this patent is extended or adjusted under 35 U.S.C. 154(b) by 329 days.

(21) Appl. No.: 17/841,334

(22) Filed: Jun. 15, 2022

(51) Int. Cl.
*A41G 5/00* (2006.01)

(52) U.S. Cl.
CPC ..... *A41G 5/0046* (2013.01)

(58) Field of Classification Search
CPC ..... A45D 2/12; A45D 2/122; A45D 2/127; A45D 2/14; A45D 2/146; A45D 2/18; A45D 2/20; A45D 2/2464; A45D 2002/007; A45D 2002/008; A45D 2002/025; A41G 5/0046
See application file for complete search history.

(56) References Cited

U.S. PATENT DOCUMENTS

| | | | | |
|---|---|---|---|---|
| 6,079,422 | A * | 6/2000 | Drago | A45D 2/362 132/246 |
| 6,116,251 | A * | 9/2000 | Stachowski | A45D 8/34 132/273 |
| 7,069,935 | B2 | 7/2006 | Bousfield et al. | |
| 8,087,414 | B2 | 1/2012 | Gutierrez Ugarte | |
| D751,255 | S | 3/2016 | Cerrito | |
| 9,370,231 | B2 | 6/2016 | Sansole et al. | |
| 9,439,489 | B1 * | 9/2016 | Townsell | A45D 8/34 |
| D822,284 | S | 7/2018 | Hosoi | |
| D895,203 | S | 9/2020 | Hsu | |

OTHER PUBLICATIONS

Sidewinder Hair Holders Review & Giveaway! Product Listing [online]. © 2009-2011 Beads, Braids & Beyond [posted on Jun. 18, 2010; retrieved on Nov. 23, 2021]. Retrieved from the Internet: <URL: http://beadsbraidsbeyond.blogspot.com/2010/06/sidewinder-hair-holders-review-giveaway.html>.

Random French Centipede Hair Braiding Tool Braider Roller Hook With Magic Hair Twist Styling Bun Maker Hair Band Accessories. Product Listing [online]. © 2010-2022 AliExpress.com [retrieved on Nov. 23, 2021]. Retrieved from the Internet: <URL: https://www.aliexpress.com/item/2251832641842387.html?gatewayAdapt=4itemAdapt>.

Braiding hair band twist black creative for Women Hair Accessories headwear holder bun bang DIY. Product Listing [online]. © 2010-2022 AliExpress.com [retrieved on Nov. 23, 2021]. Retrieved from the Internet: <URL: https://www.aliexpress.com/item/2251832653721186.html?gatewayAdapt=4itemAdapt>.

* cited by examiner

*Primary Examiner* — Rachel R Steitz
(74) *Attorney, Agent, or Firm* — Cramer Patent & Design, PLLC.; Aaron R. Cramer

(57) ABSTRACT

The hair strand styling device is a device to control hair strands while hair braiding and hair twisting. The device is made of a silicone style compound and consists of holders or trays in which hair strands, braids, or similar groupings are removably secured. The size of the invention will vary on the application. However, a typical size would be approximately a quarter inch (¼") wide and anywhere from a few inches long to a foot long. Each side of the holders or trays is performed with a rolled layer. This layer is self-winding such that it wraps up the hair material and holds it within.

1 Claim, 4 Drawing Sheets

HAIR STRAND STYLING DEVICE

RELATED APPLICATIONS

None

FIELD OF THE INVENTION

The present invention relates generally to a styling device and more specifically to a hair strand styling device.

BACKGROUND OF THE INVENTION

The industries relating to personal style and fashion are constantly growing and evolving. People are continually striving to create and maintain their personal look, style, and identity while keeping in tune with the latest trends as they hit the fashion scene. Among the many facets of which these multi-million-dollar trades are comprised, the field of hair fashion is one of the most prominent.

However, many of these styling devices, chemicals, processes and the like actually damage the hair more than help it. Many processes are expensive to perform and cannot be easily reversed. Additionally, product manufacturers are on the constant lookout for the newest and latest fad, such that they can capitalize on the market, while user can capture the attention of their friends alike. Accordingly, there exists a need for a means by which new and exciting methods of hair styling can be developed to address the needs described above. The development of the hair strand styling device fulfills this need.

SUMMARY OF THE INVENTION

The principles of the present invention provide for a hair strand styling device that has, a first rolled edge and a second rolled edge, a first end adapted to be slid along the lock of hair such that it is next to a scalp of the user, a second end adapted to receive the lock of hair that does not extend past the second end, and a decorative element matching or mimicking a plurality of natural hair. The first rolled edge and the second rolled edge having a center open area bordered by the center open area is adapted to receive a lock of hair from a user.

The center open area may be a tray-like area. The lock of hair may be treated with a liquid to facilitate manageability of the lock of hair. The liquid may be water. The lock of hair may be manipulated along an insertion path to insert the lock of hair into the center open area between the first rolled edge and the second rolled edge. The first rolled edge may be unraveled, placed over the lock of hair, and then released so that the first rolled edge may be rolled about the second rolled edge. The second rolled edge may be unraveled, placed over the lock of hair, and then released so that the first rolled edge may be rolled about the second rolled edge. The decorative element may be selected from the group consisting of color, weight, texture, shine, or outward appearance. The hair strand styling device may be attached to the hair of the user to produce outward appearance variations. The hair strand styling device may resemble the hair of the user with the lock of hair running in a same direction as the hair of the user. The hair strand styling device may resemble the hair of the user with the lock of hair running crosswise to mimic twisted styles. The hair strand styling device may be further secured by a hat, a wrap, or a scarf. The hair strand styling device may be utilized with damaged hair that should not be exposed to one or more additional chemicals. The hair strand styling device may be utilized while running, exercising, swimming, or performing other vigorous actions. The hair strand styling device may be utilized for twisting. The hair strand styling device may be utilized for braiding. The hair strand styling device may tightly encase a plurality of strands of hair but may be porous to allow fast easy drying of the hair without bacterial growth. The hair strand styling device may be in the range of a two inches to three feet. The hair strand styling device may be made of a silicone-based material. The hair strand styling device may be made of a silicone-based fabric.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
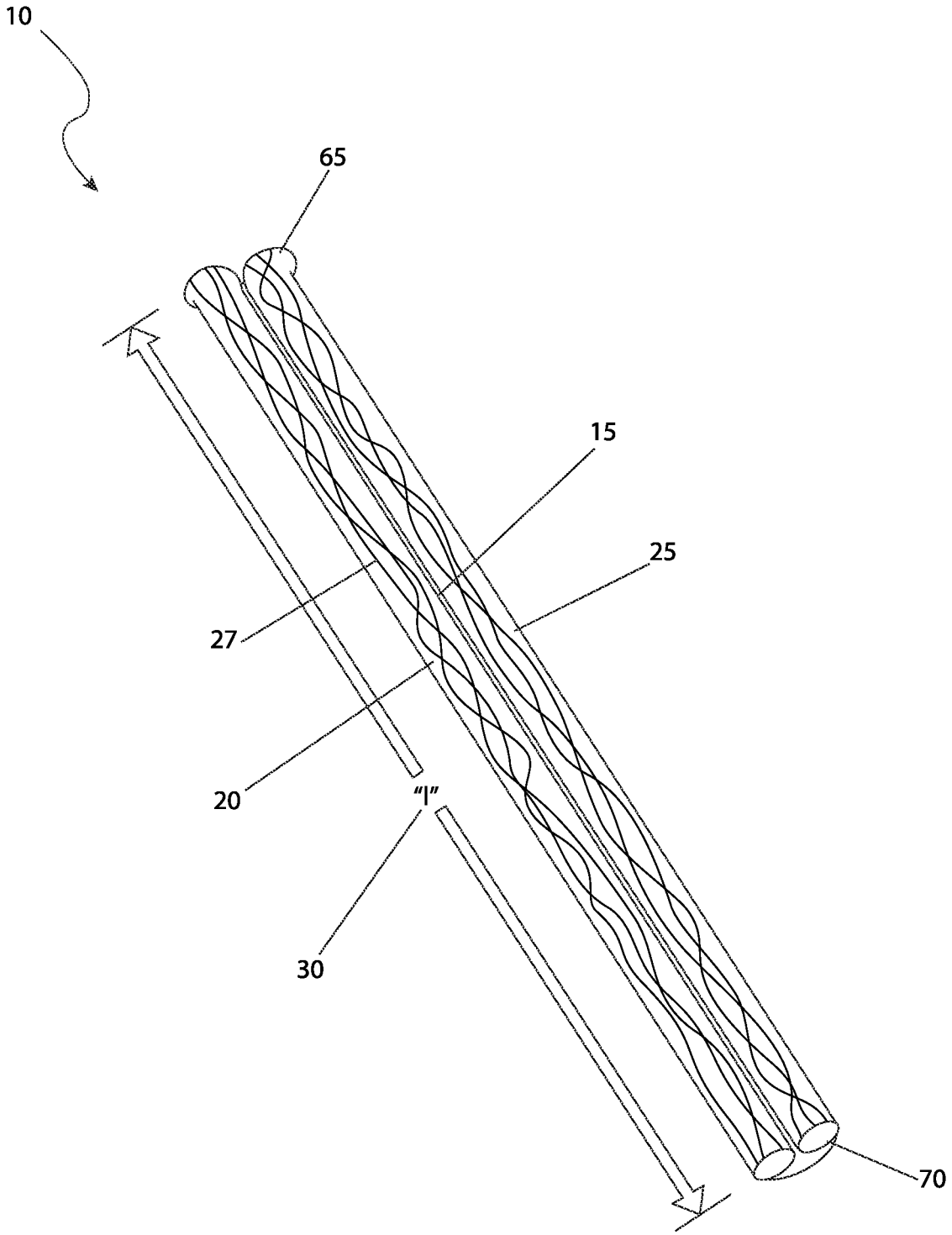
FIG. 1 is a perspective view of the hair strand styling device, according to the preferred embodiment of the present invention.

10 hair strand styling device
15 center open area
20 first rolled edge
25 second rolled edge
27 decorative element
30 linear length "l"
35 user
40 lock of hair
45 scalp
50 root
55 liquid
60 insertion path "i"
65 proximal end
70 distal end
75 hair
77 strands of hair
80 first travel path "w"
85 second travel path "p"
90 outer surface

DESCRIPTION OF THE PREFERRED EMBODIMENTS

The best mode for carrying out the invention is presented in terms of its preferred embodiment, herein depicted within FIGS. 1 through 4. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. DETAILED DESCRIPTION OF THE FIGURES

Referring now to FIG. 1, a perspective view of the hair strand styling device 10, according to the preferred embodiment of the present invention is disclosed. The hair strand styling device (herein also described as the "device") 10, is particularly suited to control a lock of hair 40. The device 10, in its open state, prior to being applied, provides a tray-like appearance, with a center open area 15 bordered by a first rolled edge 20 and a second rolled edge 25. The center open area 15 is capable of accepting a lock of hair 40 as will be shown herein below. The overall linear length "l" 30 will vary per each usage situation and is envisioned to vary from a few inches, up to several feet or more. The exact linear length "l" 30 is not intended to be a limiting factor of the present invention. It is also envisioned that the linear length "l" 30 may be selected by the final user 35 by simply cutting the device 10 with a pair of common scissors. A decorative element 27 is imprinted, embossed, formed or bonded to the outer surface 90 thereof to simulate the appearance of real hair 75. The device 10 is envisioned to be made of a silicone-based material/fabric or equivalent that is lightweight in nature, easy to handle, and resilient. This material is to be similar to that used in leave-in conditioners and thus provide shine, movement, and overall enhance the look and behavior of the hair 75. The exact material of construction of the device 10 is not intended to be a limiting factor of the present invention.

Figure 2:
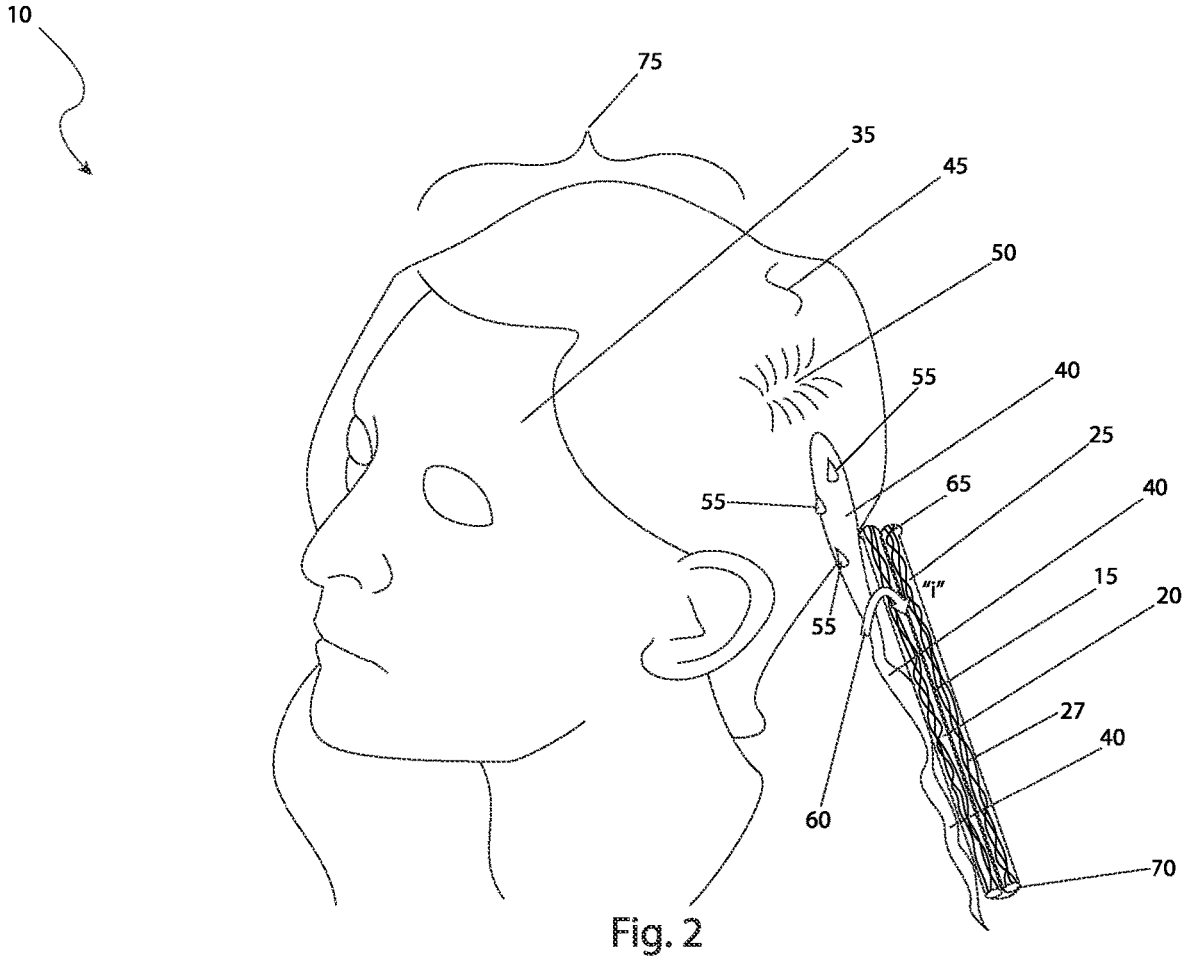
FIG. 2 is a pictorial view of the hair strand styling device shown in a state of initial utilization, according to the preferred embodiment of the present invention.

Referring next to FIG. 2, a pictorial view of the device 10 shown in a state of initial utilization, according to the preferred embodiment of the present invention is depicted. A user 35 separates a lock of hair 40 at the scalp 45 originating at the root 50. The lock of hair 40 may be treated with a liquid 55, such as water to facilitate manageability of the lock of hair 40. The device 10 as well as the lock of hair 40 is manipulated along an insertion path "i" 60 to insert the lock of hair 40 into the center open area 15 of the device 10 between the first rolled edge 20 and the second rolled edge 25. The proximal end 65 will be slid along the lock of hair 40 such that it is next to the scalp 45. The lock of hair 40 may or may not extend beyond the distal end 70. The outer surface 90, in addition to being available in varying linear length "l" 30 (as shown in FIG. 1) is also available in a decorative element 27 such as colors, weights, textures, shine, and outward appearances that match or mimic natural hair 75. These variations are envisioned to match or contrast with the natural properties of the hair 75 of the user 35. These variations allow for twisting or braiding of the device 10 as well. The device 10 may be used as part of a hair styling process and thus removed, once a hair styling process is completed. However, a far more common application is that the device 10 is left attached to the hair 75 of the user 35 to produce outward appearance variations that are eye-catching due to texture, color, appearance or the like due to the decorative element 27. The device 10 may be utilized while running, exercising, swimming or performing other vigorous actions, however, a securing method near the proximal end 65 end of the device 10, such as a hat, wrap, scarf, or the like may be required. The device 10 may be used on all types of hair 75 from straight to the tightest curls. Finally, the device 10 is perfect for use with damaged hair 75 that should not be exposed to any additional chemicals and helps to reduce damaged ends, tangles, and the elimination or reduction of usage of wigs and/or hair extensions.

The device 10 would be resemble the hair 75 of the user 35 with lock of hair 40 running in the same direction as the hair 75 or crosswise to mimic twisted styles. Additionally, the user 35 of the device 10 produces a final appearance of hair 75 with more volume, especially with user 35 possessing thin hair 75. Finally, the device 10 is envisioned as being useful with damaged hair 75 that should not be exposed to any additional chemicals and helps to reduce associated hair problems such as damaged ends, tangles, and the use of wigs and/or hair extensions.

Figure 3:
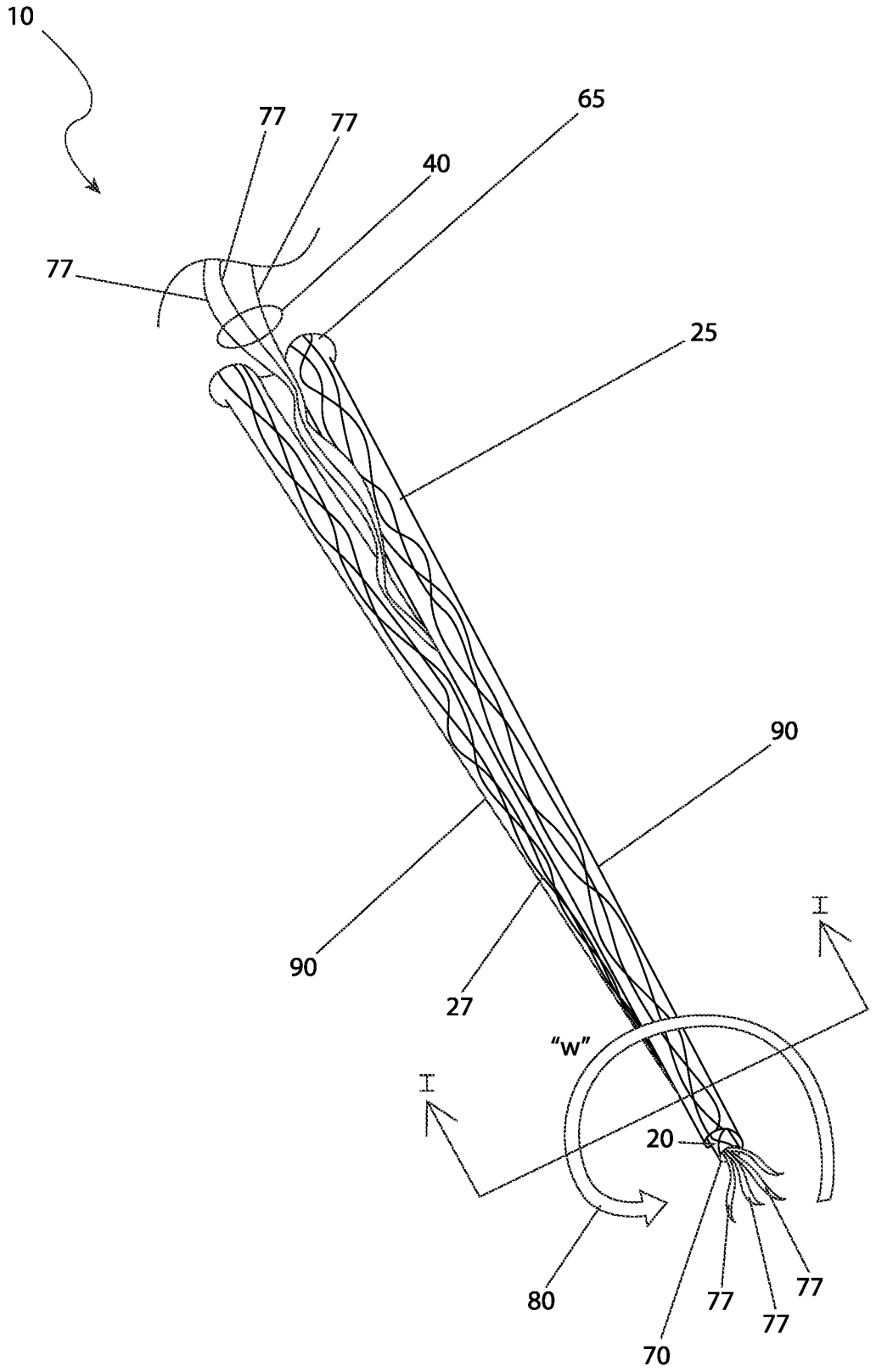
FIG. 3 is a perspective view of the hair strand styling device, shown in a state of being applied to lock of hair, according to the preferred embodiment of the present invention.

Referring now to FIG. 3, a perspective view of the device 10, shown in a state of being applied to lock of hair 40, according to the preferred embodiment of the present invention is shown. The lock of hair 40, consisting of multiple strands of hair 77 are placed in the center open area 15 as shown in FIG. 2, from the proximal end 65 to the distal end 70, in the center open area 15 and between the first rolled edge 20 and the second rolled edge 25. With the strands of hair 77 in place, the user 35 would then unroll either the first rolled edge 20 or the second rolled edge 25 and roll it over the second rolled edge 25 or the first rolled edge 20, respectively, at the distal end 70 along a first travel path "w" 80 The winding motion then continues towards the proximal end 65 along a second travel path "p" 85 with sequential first travel paths "w" 80 taking place until the entire length of the device 10 is completely engaged (as shown in the distal end 70 of the device 10 as depicted in FIG. 3). This action produces a final outer surface 90 with a decorative element 27 that mimics various hair textures.

Figure 4:
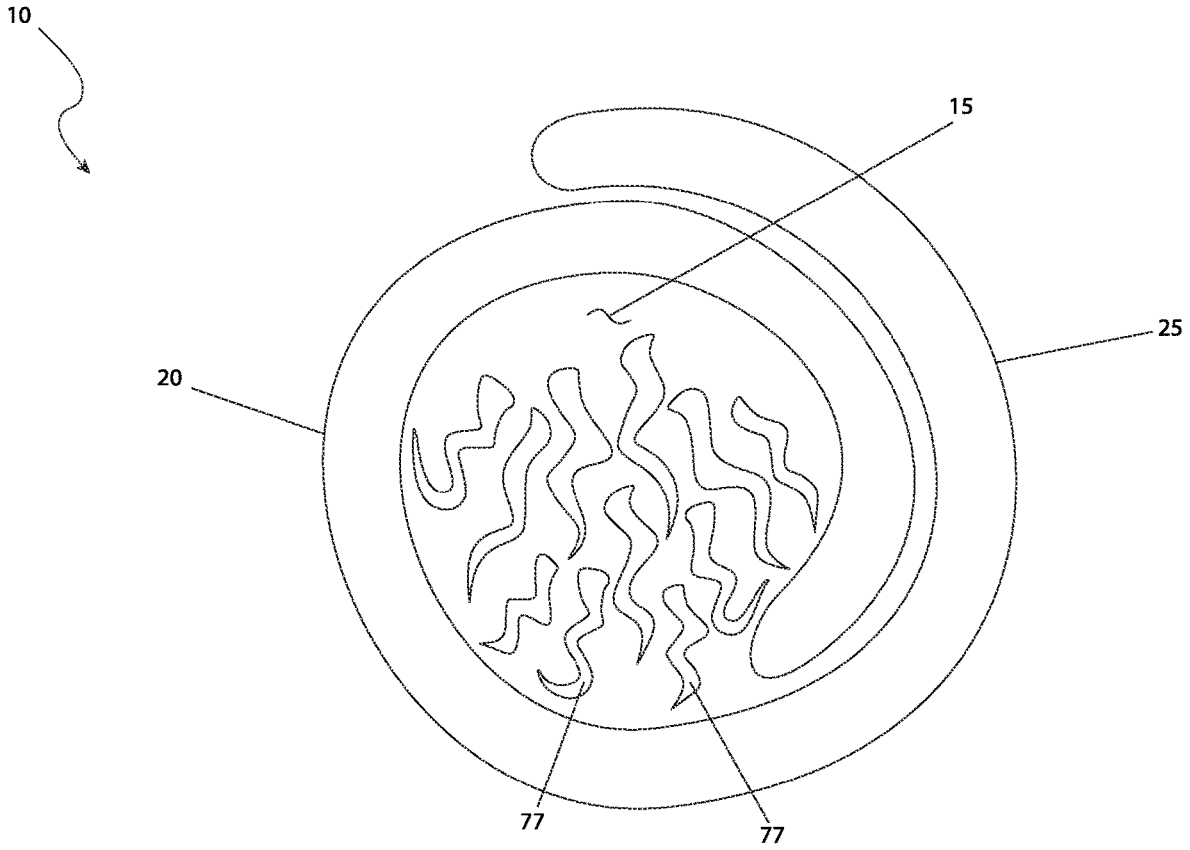
FIG. 4 is a sectional view of the hair strand styling device, as seen along a Line II-II, as shown in FIG. 3, according to the preferred embodiment of the present invention.

Referring to FIG. 4, a sectional view of the device 10, as seen along a Line II-II, as shown in FIG. 1, according to the preferred embodiment of the present invention is depicted. The first rolled edge 20 or the second rolled edge 25 is unraveled, placed over the lock of hair 40, and then released so that it the first rolled edge 20 is rolled about the second rolled edge 25, or vice vera. This action captures the strands of hair 77 in the center open area 15 between the first rolled edge 20 and the second rolled edge 25. The strands of hair 77 are held in place via friction fit. If and when removal of the device 10 from the hair 75 of the user 35 (both of which are shown in FIG. 2) is desired, the process is repeated, but the lock of hair 40 is removed from the center open area 15. The device 10 tightly encases the strands of hair 77 but is porous to allow fast easy drying of the hair 75 without bacterial growth. The device 10 has no openings or holes thus avoiding issues with ends of hair 75.

2. OPERATION OF THE PREFERRED EMBODIMENT

The preferred embodiment of the present invention can be utilized by the common user 35 in a simple and effortless manner with little or no training. It is envisioned that the device 10 would be constructed in general accordance with FIG. 1 through FIG. 5. The user 35 would procure the device 10 from conventional procurement channels such as beauty supply houses, discount stores, department stores, drug stores, mail order and internet supply houses and the like. Special attention would be paid to the linear length "l" 30, pre-cut or user-cut version, colors, styles, outer surface 90, and the like.

After procurement and prior to utilization, the device 10 would be prepared in the following manner: the device 10 would be cut to the desired linear length "l" 30. At this point in time, the device 10 is ready for utilization.

During utilization of the device 10, the following procedure would be initiated: the user 35 would clean and detangle hair 77 as required; the user 35 would separate a lock of hair 40 at the root 50, preferably using a comb in a conventional manner; liquid 55 may be applied if desired, while ensuring the lock of hair 40 is straight and manageable; the lock of hair 40, consisting of the strands of hair 77 are placed in the center open area 15, between the first rolled edge 20 and the second rolled edge 25 as shown in FIG. 3; the user 35 would then unroll either or both the first rolled edge 20 and the second rolled edge 25 at the distal end 70 along a first travel path "w" 80 to capture the lock of hair 40; the winding motion then continues towards the proximal end 65 along a second travel path "p" 85 with sequential first travel paths "w" 80 taking place until the entire length of the device 10 is completely engaged (as shown in the distal end 70 of the device 10 as depicted in FIG. 3). At this point in time additional styling with the device 10 in place may occur.

After use of the hair strand styling device 10, the user may remove the device 10 by grasping the outer surface 90 and reversing the first travel path "w" 80, thus peeling pack either the first rolled edge 20 or the second rolled edge 25, thus revealing the center open area 15 to allow for the lock of hair 40 to be removed and thus resetting the device 10 for future re-use in a circular manner.

The features of the device 10 provide the following characteristics and benefits: versatility, customization for each user 35, durability, safe, realistic appearance, quick to install or apply, creative, easy, fashionable and provides for the protection of the hair 75 of the user 35.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A hair strand styling device, consisting of:

a flexible body defining a center open area, said center open area being longitudinally bordered by a first rolled edge and a second rolled edge, said center open area configured to receive and encase a lock of hair;

a proximal end and a distal end, wherein the proximal end is configured to be positioned adjacent to a scalp of a user, and the distal end is configured to limit extension of the lock of hair within the center open area;

wherein the first rolled edge is configured to be unrolled and rolled over the second rolled edge, and the second rolled edge is configured to be unrolled and rolled over the first rolled edge, thereby allowing the first rolled edge and the second rolled edge to be alternately rolled over one another to frictionally secure the lock of hair within the center open area from the distal end toward the proximal end;

wherein the outer surface of the flexible body includes a decorative element selected from the group consisting of textures, colors, weights, shine, and outward appearances that match or mimic a natural hair appearance;

wherein the flexible body is made of a resilient, lightweight, porous material comprising a silicone-based fabric that allows airflow to the lock of hair positioned within the center open area, thereby facilitating drying and reducing potential bacterial growth;

wherein the flexible body is configured to be cut to a selected linear length by a user, and the outer surface of the flexible body is adapted to allow the device to be twisted, braided, or otherwise a manipulated into a desired hair style configuration; and wherein the hair strand styling device is further configured to produce a volumizing effect, support the appearance of twisted hair styles, protect against chemical exposure and damage, and reduce tangles, split ends, and the need for wigs or hair extensions.

* * * * *